US009761161B2

(12) United States Patent
Tseng

(10) Patent No.: US 9,761,161 B2
(45) Date of Patent: Sep. 12, 2017

(54) METHOD AND DEVICE FOR REDUCING IMAGING STICKING, AND DISPLAY DEVICE

(71) Applicant: BOE TECHNOLOGY GROUP CO., LTD., Beijing (CN)

(72) Inventor: Szuheng Tseng, Beijing (CN)

(73) Assignee: BOE TECHNOLOGY GROUP CO., LTD. (CN)

( * ) Notice: Subject to any disclaimer, the term of this patent is extended or adjusted under 35 U.S.C. 154(b) by 124 days.

(21) Appl. No.: 14/429,768

(22) PCT Filed: Aug. 13, 2014

(86) PCT No.: PCT/CN2014/084281

§ 371 (c)(1),
(2) Date: Mar. 19, 2015

(87) PCT Pub. No.: WO2015/113394

PCT Pub. Date: Aug. 6, 2015

(65) Prior Publication Data

US 2016/0027353 A1 Jan. 28, 2016

(30) Foreign Application Priority Data

Jan. 29, 2014 (CN) ..... 2014 1 0043704

(51) Int. Cl.
*G09G 5/10* (2006.01)
*G09G 3/00* (2006.01)
*G09G 3/3225* (2016.01)

(52) U.S. Cl.
CPC ..... *G09G 3/006* (2013.01); *G09G 3/3225* (2013.01); *G09G 2320/0257* (2013.01);
(Continued)

(58) Field of Classification Search
CPC ..... G09G 3/3413; G09G 3/342; G09G 3/3607
(Continued)

(56) References Cited

U.S. PATENT DOCUMENTS

2008/0111886 A1* 5/2008 Bai ..... G09G 3/20 348/173
2009/0079873 A1 3/2009 Otawara
(Continued)

FOREIGN PATENT DOCUMENTS

CN 1413015 4/2003
CN 1460967 12/2003
(Continued)

OTHER PUBLICATIONS

First Office Action issued in corresponding Chinese Application No. 2014100437047 dated May 20, 2015.
(Continued)

*Primary Examiner* — Long D Pham
(74) *Attorney, Agent, or Firm* — Brooks Kushman P.C.

(57) ABSTRACT

The present disclosure provides a method and a device for reducing image sticking and a display device. The method includes sequentially acquiring a plurality of display frames from a display device; dividing each of the plurality of display frames into a plurality of blocks; and judging that there is a possibility of image sticking when blocks having identical or similar image information are included at an identical position in X consecutive display frames, wherein X is a positive integer greater than or equal to 2.

15 Claims, 7 Drawing Sheets

(52) U.S. Cl.
CPC ... *G09G 2320/046* (2013.01); *G09G 2330/04* (2013.01); *G09G 2360/16* (2013.01)

(58) Field of Classification Search
USPC ..... 345/690
See application file for complete search history.

(56) References Cited

U.S. PATENT DOCUMENTS

| | | | | |
|---|---|---|---|---|
| 2009/0096778 | A1 | 4/2009 | Su et al. | |
| 2010/0060554 | A1 | 3/2010 | Koh et al. | |
| 2011/0043551 | A1* | 2/2011 | Kikuta | G09G 3/3233 345/691 |
| 2013/0257884 | A1* | 10/2013 | Koh | G09G 3/3208 345/545 |

FOREIGN PATENT DOCUMENTS

| | | |
|---|---|---|
| CN | 101009077 | 8/2007 |
| CN | 101256731 | 9/2008 |
| CN | 101996591 | 3/2011 |
| CN | 102549644 | 7/2012 |
| CN | 103761941 | 4/2014 |
| EP | 1526500 | 4/2005 |

OTHER PUBLICATIONS

International Search Report and Written Opinion issued in corresponding International Application No. PCT/CN2014/084281 dated Nov. 19, 2014.

* cited by examiner

METHOD AND DEVICE FOR REDUCING IMAGING STICKING, AND DISPLAY DEVICE

CROSS-REFERENCE TO RELATED APPLICATIONS

The present application is the U.S. National Phase of International Application No. PCT/CN2014/084281, filed on Aug. 13, 2014, and claims priority to Chinese patent application No. 201410043704.7, filed on Jan. 29, 2014, which are incorporated herein by reference in their entirety.

TECHNICAL FIELD

The present disclosure relates to the field of display technology, in particular to a method and a device for reducing image sticking, and a display device.

BACKGROUND

As compared with a typical liquid crystal panel, an active matrix organic light-emitting diode (AMOLED) panel has such features as a rapid response speed, a high contrast and a wide viewing angle, and thus has attracted more attention in the industry.

Due to limitations in materials, the AMOLED may easily be aged rapidly, resulting in image sticking. Various prevention mechanisms have been presented in the related art when determining that the image sticking is likely to occur. However, how to determine the timing when the image sticking is likely to occur is seldom mentioned in the related art.

SUMMARY

In view of this, the present disclosure provides in one embodiment a method and a device for reducing image sticking, and a display device, so as to accurately determine the timing when the image sticking is likely to occur.

In order to solve the above technical problem, the present disclosure provides in one embodiment a method for reducing image sticking, including:

an acquisition step of sequentially acquiring a plurality of display frames from a display device;

a dividing step of dividing each of the plurality of display frames into a plurality of blocks; and a first judgment step of judging that there is a possibility of image sticking when blocks having identical or similar image information are included at an identical position in X consecutive display frames, wherein X is a positive integer greater than or equal to 2.

Alternatively, after the dividing step and before the first judgment step, the method further includes:

a second judgment step of judging whether or not blocks having identical or similar image information are included at an identical position in two consecutive display frames;

a first determination step of determining brightness information of the blocks having the identical or similar image information at the identical position when the blocks having the identical or similar image information are included at the identical position in the two consecutive display frames; and a second determination step of determining the number X of the display frames required for judging of image sticking in accordance with the brightness information of the blocks having the identical or similar image information at the identical position.

Alternatively, brightness of the blocks having the identical or similar image information at the identical position is inversely proportional to the number X of the display frames.

Alternatively, the image information of the block is a sum of data of all pixels in the block, the blocks having the identical image information at the identical position refer to blocks having an identical sum of data of all the pixels in the respective blocks at the identical position, and the blocks having the similar image information at the identical position refer to blocks at the identical position in which a difference between the sums of data of all the pixels falls within a predetermined range.

Alternatively, the image information of the block is data of each pixel in the block, the blocks having the identical image information at the identical position refer to blocks having identical data for each pixel in the respective blocks at the identical position, and the blocks having the similar information at the identical position refer to blocks having an identical sum of data of the pixels at a predetermined percentage in the respective blocks at the identical position.

Alternatively, after the step of judging that there is a possibility of image sticking, the method further includes an execution step of executing a prevention mechanism for image sticking.

Alternatively, the execution step includes:

shifting a position of an image in a current display frame to be displayed; or reducing brightness of the current display frame to be displayed.

Alternatively, the plurality of blocks is of an identical size or different sizes.

Alternatively, the brightness information of the block is a sum of the data of all pixels in the block.

The present disclosure provides in one embodiment a device for reducing image sticking, including:

an acquisition module configured to sequentially acquire a plurality of display frames from a display device;

a dividing module configured to divide each of the plurality of display frames into a plurality of blocks; and a judgment module configured to judge that there is a possibility of image sticking when blocks having identical or similar image information are included at an identical position in X consecutive display frames, wherein X is a positive integer greater than or equal to 2.

The device further includes:

a second judgment module configured to judge whether or not blocks having identical or similar image information are included at an identical position in two consecutive display frames;

a first determination module configured to determine brightness information of the blocks having the identical or similar image information at the identical position when the blocks having the identical or similar image information are included at the identical position in the two consecutive display frames; and a second determination module configured to determine the number X of the display frames required for judging of image sticking in accordance with the brightness information of the blocks having the identical or similar image information at the identical position.

Alternatively, brightness of the blocks having the identical or similar image information at the identical position is inversely proportional to the number X of the display frames.

Alternatively, the image information of the block is a sum of data of all pixels in the block, the blocks having the identical image information at the identical position refer to blocks having an identical sum of data of all the pixels in the respective blocks at the identical position, and the blocks having the similar image information at the identical position refer to blocks at the identical position in which a difference between the sums of data of all the pixels falls within a predetermined range.

Alternatively, the image information of the block is data of each pixel in the block, the blocks having the identical image information at the identical position refer to blocks having identical data for each pixel in the respective blocks at the identical position, and the blocks having the similar information at the identical position refer to blocks having an identical sum of data of the pixels at a predetermined percentage in the respective blocks at the identical position.

Alternatively, the device further includes an execution module configured to execute a prevention mechanism for image sticking after the judgment module judges that there is the possibility of image sticking.

Alternatively, the execution module is configured to shift a position of an image in a current display frame to be displayed, or reduce brightness of the current display frame to be displayed.

The present disclosure further provides in one embodiment a display device including the above-mentioned device for reducing image sticking.

Beneficial effects of the above technical solution of the embodiments of the present disclosure are as follows.

The timing when the image sticking is likely to occur may be effectively judged, thereby to facilitate the subsequent execution of the prevention mechanism for image sticking.

DETAILED DESCRIPTION

Image sticking of a display device mainly occurs for following two reasons: (1) an identical display frame is lightened for a long period of time, and (2) the identical display frame is lightened at a high brightness.

Considering the above, the present disclosure provides in embodiments a method and a device for reducing image sticking and a display device, so as to accurately judge the timing when the image sticking is likely to occur.

In order to make the technical problem to be solved, the technical solutions and the advantages of the present disclosure more apparent, the present disclosure will be described hereinafter in conjunction with the drawings and the embodiments.

The following first to third embodiments are provided at least on the basis of the above reason (1).

First Embodiment

Figure 1:
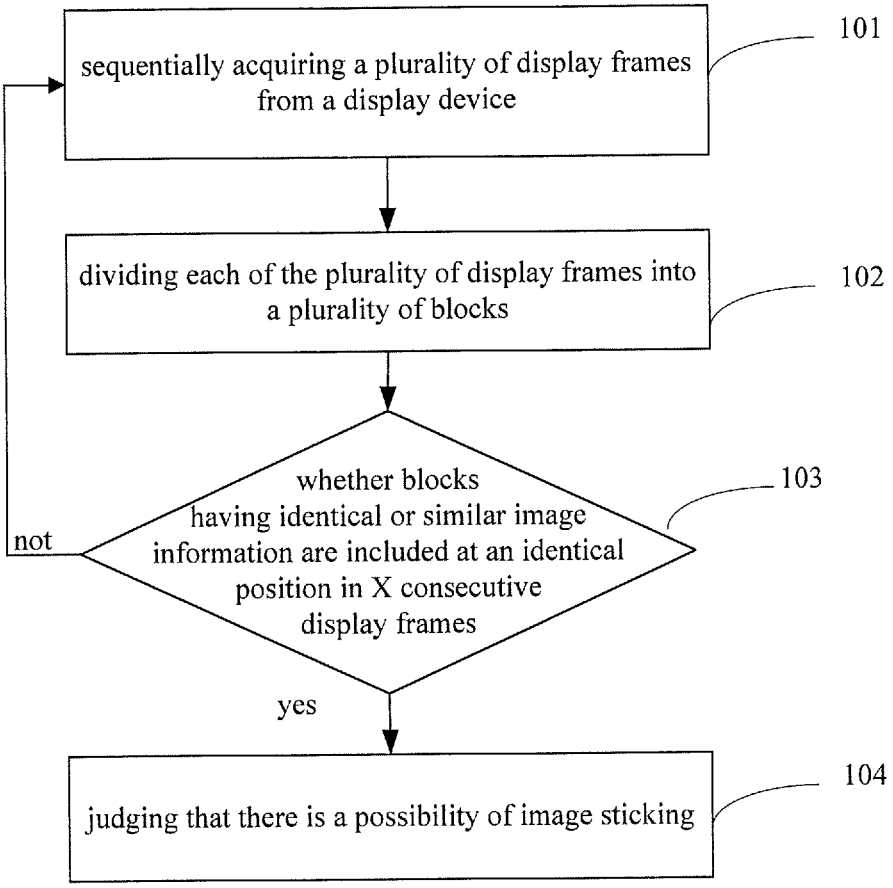
FIG. 1 is a flow chart of a method for reducing image sticking according to a first embodiment of the present disclosure.

Referring to FIG. 1, FIG. 1 is a flow chart of a method for reducing image sticking according to the first embodiment of the present disclosure, the method includes following steps.

Step 101: sequentially acquiring a plurality of display frames from a display device.

Step 102: dividing each of the plurality of display frames into a plurality of blocks. In this embodiment, the shape and the number of the divided blocks are not particularly limited. In addition, the blocks obtained by dividing one display frame may be of an identical size or different sizes.

In some other embodiments of the present disclosure, there is such a dividing mode in the extreme case that each block just includes one pixel point.

Step 103: judging whether or not blocks having identical or similar image information are included at an identical position in X consecutive display frames; if yes, proceeding to Step 104, otherwise, returning to Step 101. X is a positive integer greater than or equal to 2.

Step 104: judging that there is a possibility of image sticking.

The image information may be a sum of data of all pixels in the block. Then, the blocks having identical image information at an identical position refer to blocks having an identical sum of data of all the pixels in the respective blocks at the identical position; and the blocks having similar image information at an identical position refer to blocks at the identical position in which a difference between the sums of data of all the pixels falls within a predetermined range.

The image information may also be data of each pixel in the block. Then, the blocks having identical image information at an identical position refer to blocks having identical data for each pixel in the respective blocks at the identical position; and the blocks having similar information at the identical position refer to blocks having an identical sum of data for Y % of the pixels in the respective blocks at the identical position, for example, Y is 90 or other values.

According to the method in the above embodiment, the timing when the image sticking is likely to occur may be effectively judged, thereby to facilitate the subsequent execution of a prevention mechanism for image sticking.

In the above embodiment, after the step of judging that there is a possibility of image sticking, the method may further include a step of executing the prevention mechanism for image sticking.

Specifically, the step of executing the prevention mechanism for image sticking may include: shifting a position of an image in a current display frame to be displayed; or reducing brightness of the current display frame to be displayed.

Of course, the step of executing the prevention mechanism for image sticking is not limited to the above two modes. For example, other prevention mechanisms may also be adopted.

Second Embodiment

Figure 2:
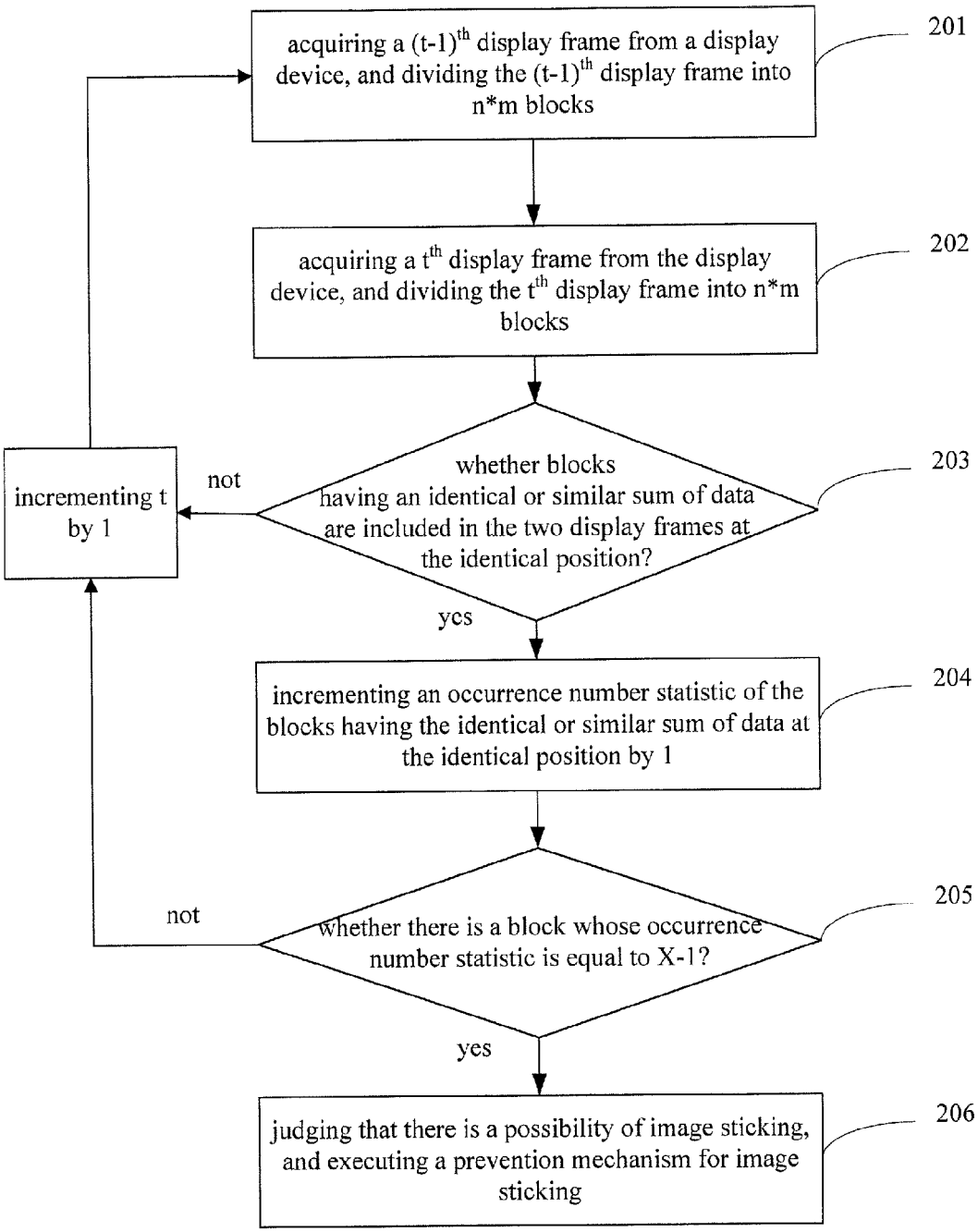
FIG. 2 is a flow chart of a method for reducing image sticking according to a second embodiment of the present disclosure.

Referring to FIG. 2, FIG. 2 is a flow chart of a method for reducing image sticking according to the second embodiment of the present disclosure, the method includes the following steps.

Step 201: acquiring a $(t-1)^{th}$ display frame from a display device, and dividing the $(t-1)^{th}$ display frame into n*m blocks, where t is a positive integer greater than 1, and n and m are both positive integers greater than or equal to 2. In this embodiment, the n*m blocks are of an identical size.

Figure 3:
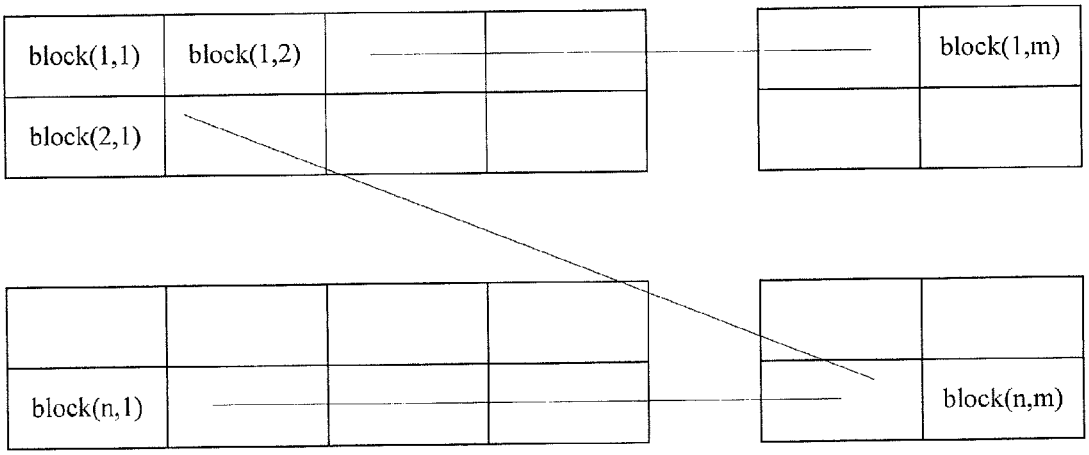
FIG. 3 is a schematic view showing a display frame which is divided into n*m blocks according to the second embodiment of the present disclosure.

Referring to FIG. 3, FIG. 3 shows the display frame which is divided into n*m blocks.

Step 202: acquiring a $t^{th}$ display frame from the display device, and dividing the $t^{th}$ display frame into n*m blocks.

Step 203: comparing sums of data of all the pixels in blocks at an identical position of the $(t-1)^{th}$ display frame and the $t^{th}$ display frame, judging whether or not blocks having an identical or similar sum of data are included in the $t^{th}$ and $(t-1)^{th}$ display frames at the identical position, if yes, proceeding to Step 204, otherwise, proceeding to Step 207.

Step 204: incrementing an occurrence number statistic of the blocks having the identical or similar sum of data at the identical position by 1, an initial value of the occurrence number statistic being 0.

Step 205: judging whether or not there is a block whose occurrence number statistic is equal to X−1, where X is a positive integer greater than or equal to 2; if yes, proceeding to Step 206, otherwise, proceeding to Step 207.

Step 206: judging that there is a possibility of image sticking, and executing a prevention mechanism for image sticking.

Step 207: incrementing t by 1, and returning to Step 201.

Figure 4:
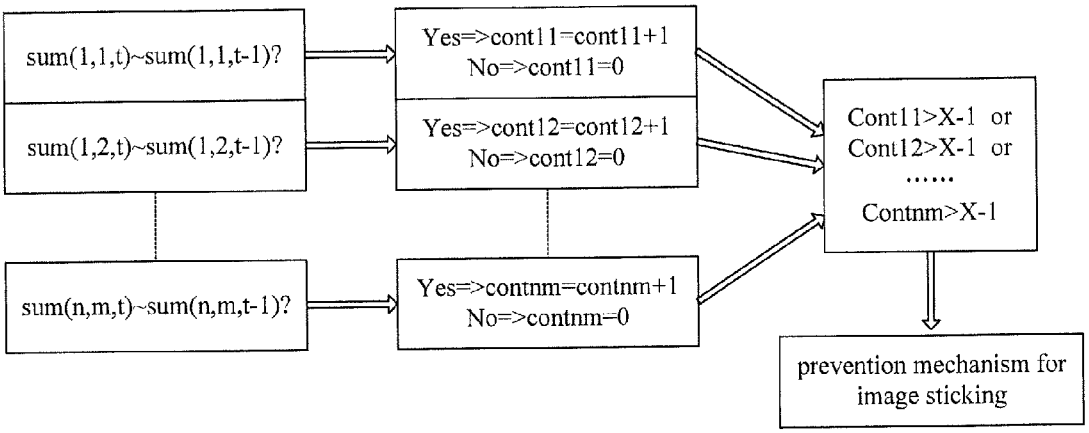
FIG. 4 is a schematic view showing a method for comparing sums of data of all pixels in the blocks according to the second embodiment of the present disclosure.

Referring to FIG. 4, FIG. 4 is a schematic view showing a method for comparing sums of data of all the pixels in the blocks according to the second embodiment of the present disclosure; sum(n,m,t) represents a sum of data in a block (n,m) for the $t^{th}$ frame, and contnm represents a occurrence number statistic of the block (n,m).

Third Embodiment

The present disclosure provides in this embodiment a device for reducing image sticking, including:

an acquisition module configured to sequentially acquire a plurality of display frames from a display device;

a dividing module configured to divide each of the plurality of display frames into a plurality of blocks; and a judgment module configured to judge whether or not blocks having identical or similar image information are included at an identical position in X consecutive display frames, if yes, judge that there is a possibility of image sticking, where X is a positive integer greater than or equal to 2.

Alternatively, the device for reducing image sticking may further include an execution module configured to execute a prevention mechanism for image sticking after the judgment module judges that there is the possibility of image sticking.

In this embodiment, the shape and the number of the divided blocks are not particularly limited. In addition, the blocks obtained by dividing one display frame may be of an identical size or different sizes.

In some other embodiments of the present disclosure, there is such a dividing mode in the extreme case that each block just includes one pixel point.

The image information may be a sum of data of all pixels in the block. Then, the blocks having the identical image information at an identical position refer to blocks having an identical sum of data of all the pixels in the respective blocks at the identical position; and the blocks having similar image information at an identical position refer to blocks at the identical position in which a difference between the sums of data of all the pixels falls within a predetermined range.

The image information may also be data of each pixel in the block. Then, the blocks having identical image information at an identical position refer to blocks having identical data for each pixel in the respective blocks at the identical position; and the blocks having similar information at an identical position refer to blocks having an identical sum of data for Y % of the pixels in the respective blocks at the identical position, for example, Y is 90.

According to the device provided in the above embodiment, the timing when the image sticking is likely to occur may be effectively judged, thereby to facilitate the subsequent execution of a prevention mechanism for image sticking.

In the above embodiment, after the step of judging that there is a possibility of image sticking, the method may further include a step of executing the prevention mechanism for image sticking.

Specifically, the execution module may execute the prevention mechanism for image sticking by: shifting a position of an image in a current display frame to be displayed; or reducing the brightness of the current display frame to be displayed.

Of course, the execution of the prevention mechanism for image sticking is not limited to the above two modes, and other prevention mechanisms in the related art may also be adopted.

The following fourth to seventh embodiments are provided at least on the basis of the above reason (2).

Fourth Embodiment

Figure 5:
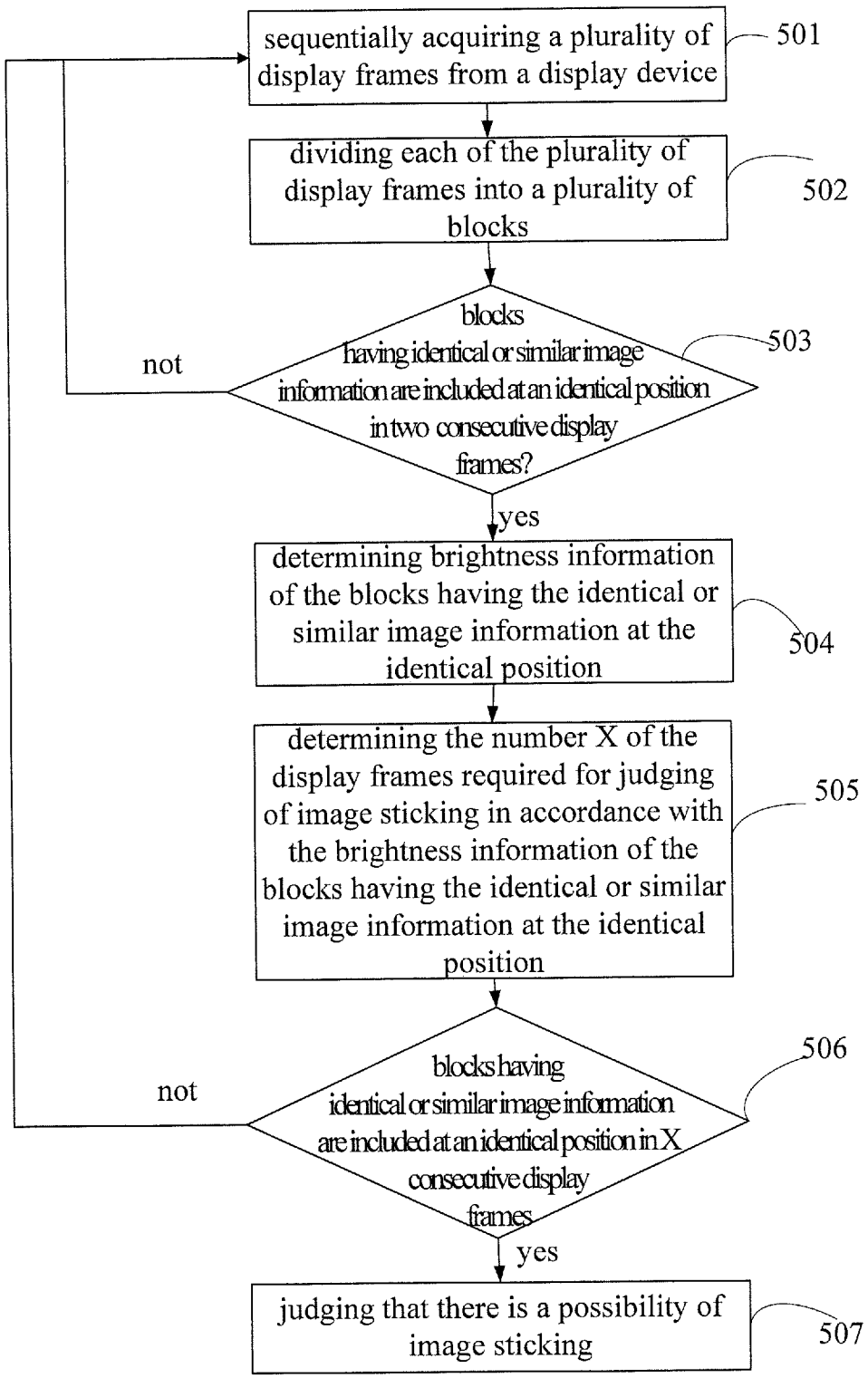
FIG. 5 is a flow chart of a method for reducing image sticking according to a fourth embodiment of the present disclosure.

Referring to FIG. 5, FIG. 5 is a flow chart of a method for reducing image sticking according to the fourth embodiment of the present disclosure, the method includes the following steps.

Step 501: sequentially acquiring a plurality of display frames from a display device.

Step 502: dividing each of the plurality of display frames into a plurality of blocks.

In this embodiment, the shape and the number of the divided blocks are not particularly limited. In addition, the blocks obtained by dividing one display frame may be of an identical size or different sizes.

In some other embodiments of the present disclosure, there is such a dividing mode in the extreme case that each block just includes one pixel point.

Step 503: judging whether or not blocks having identical or similar image information are included at an identical position in two consecutive display frames, if yes, proceeding to Step 504, otherwise, returning to Step 501.

Step 504: determining brightness information of the blocks having the identical or similar image information at the identical position.

Step 505: determining the number X of the display frames required for judging of image sticking in accordance with the brightness information of the blocks having the identical or similar image information at the identical position. Brightness of the blocks having the identical or similar image information at the identical position is inversely proportional to the number X of the display frames.

Specifically, the larger the brightness of the blocks having the identical or similar image information at the identical position, the smaller the number X of the display frames required for judging of image sticking.

Step 506: judging whether or not blocks having identical or similar image information are included at an identical position in X consecutive display frames; if yes, proceeding to Step 507, otherwise, returning to Step 501.

Step 507: judging that there is a possibility of image sticking.

X is a positive integer greater than or equal to 2.

In this embodiment, the image information may be a sum of data of all pixels in the block. Then, the blocks having identical image information at an identical position refer to blocks having an identical sum of data for all the pixels in the respective blocks at the identical position; and the blocks having similar image information at an identical position refer to blocks at the identical position in which a difference between the sums of data of all the pixels falls within a predetermined range.

The image information may also be data of each pixel in the block. Then, the blocks having identical image information at an identical position refer to blocks having identical data for each pixel in the respective blocks at the identical position; and the blocks having similar information at the identical position refer to blocks having an identical sum of data for Y % of the pixels in the respective blocks at the identical position, for example, Y is 90.

The brightness information of the block may be a sum of data of all the pixels in the block.

According to the method provided in the above embodiment, the timing when the image sticking is likely to occur may be effectively judged, thereby to facilitate the subsequent execution of a prevention mechanism for image sticking.

In the above embodiment, after the step of judging that there is a possibility of image sticking, the method may further include a step of executing the prevention mechanism for image sticking.

Specifically, the step of executing the prevention mechanism for image sticking may include: shifting a position of an image in a current display frame to be displayed; or reducing the brightness of the current display frame to be displayed.

Of course, the step of executing the prevention mechanism for image sticking is not limited to the above two modes, and other prevention mechanisms in the related art may also be adopted.

Fifth Embodiment

Figure 6:
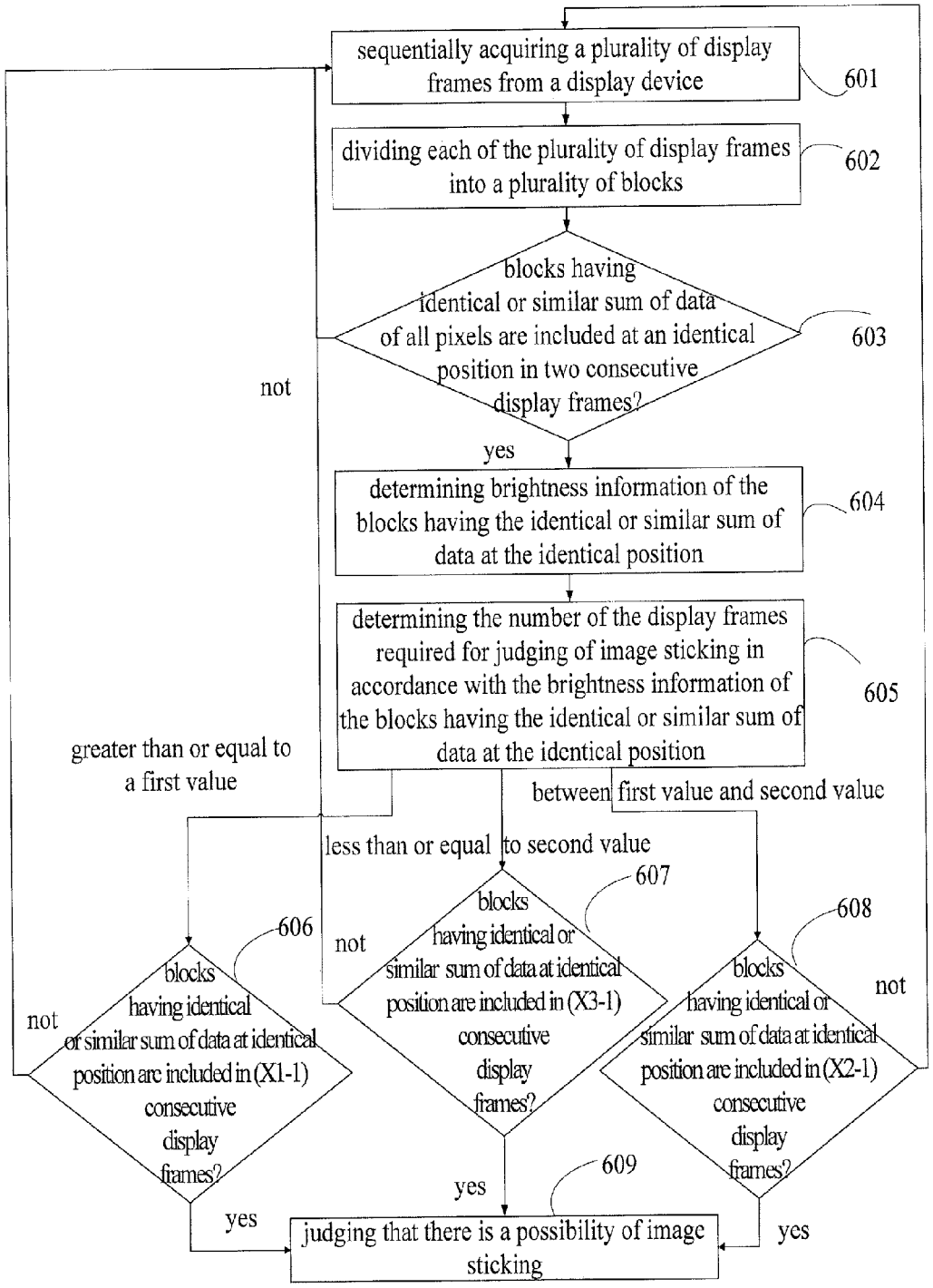
FIG. 6 is a flow chart of a method for reducing image sticking according to a fifth embodiment of the present disclosure.

Referring to FIG. 6, FIG. 6 is a flow chart of a method for reducing image sticking according to the fifth embodiment of the present disclosure, the method includes the following steps.

Step 601: sequentially acquiring a plurality of display frames from a display device.

Step 602: dividing each of the plurality of display frames into a plurality of blocks.

In this embodiment, the shape and the number of the divided blocks are not particularly limited. In addition, the blocks obtained by dividing one display frame may be of an identical size or different sizes.

Step 603: judging whether or not blocks having identical or similar sum of data of all the pixels are included at an identical position in two consecutive display frames; if yes, proceeding to Step 604, otherwise, returning to Step 601.

Step 604: determining brightness information of the blocks having the identical or similar sum of data at the identical position.

Step 605: determining the number of the display frames required for judging of image sticking in accordance with the brightness information of the blocks having the identical or similar sum of data at the identical position. Brightness of the blocks having the identical or similar sum of data at the identical position is inversely proportional to the number of the display frames.

Specifically, the larger the brightness of the blocks having the identical or similar sum of data at the identical position, the smaller the number of the display frames required for judging of image sticking.

Since the sum of data of all the pixels in the block may represent the brightness of the block, and the larger the sum of data, the larger the brightness, thus, in this embodiment, the brightness information of the block may also be the sum of data of all the pixels in the block.

Step 606: when the brightness of the blocks having the identical or similar sum of data at the identical position is greater than or equal to a first value, judging whether or not the blocks having the identical or similar sum of data at the identical position are included in (X1−1) consecutive display frames; if yes, proceeding to Step 609, otherwise, returning to Step 601.

Step 607: when the brightness of the blocks having the identical or similar sum of data at the identical position is less than or equal to a second value, judging whether or not the blocks having the identical or similar sum of data at the identical position are included in (X3−1) consecutive display frames; if yes, proceeding to Step 609, otherwise, returning to Step 601.

Step 608: when the brightness of the blocks having the identical or similar sum of data at the identical position is between the first value and the second value, judging whether or not the blocks having the identical or similar sum of data at the identical position are included in (X2−1) consecutive display frames; if yes, proceeding to Step 609, otherwise, returning to Step 601.

X1 is a positive integer greater than or equal to 2, X2 and X3 are both positive integers greater than 2, X3>X2>X1, and the first value is greater than the second value.

Step 609: judging that there is a possibility of image sticking.

According to the method provided in the above embodiment, the timing when the image sticking is likely to occur may be effectively judged, thereby to facilitate the subsequent execution of a prevention mechanism for image sticking.

In the above embodiment, the brightness information of the block is divided into three numerical ranges, each of which corresponds to the number of display frames required for judging of image sticking. Of course, in other embodiments of the present disclosure, the brightness information of the block may also be divided into not less than two numerical ranges.

In the above embodiment, after the step of judging that there is a possibility of image sticking, the method may further include a step of executing the prevention mechanism for image sticking.

Specifically, the step of executing the prevention mechanism for image sticking may include: shifting a position of an image in a current display frame to be displayed; or reducing the brightness of the current display frame to be displayed.

Of course, the step of executing the prevention mechanism for image sticking is not limited to the above two modes, and other prevention mechanisms in the related art may also be adopted.

Sixth Embodiment

Figure 7:
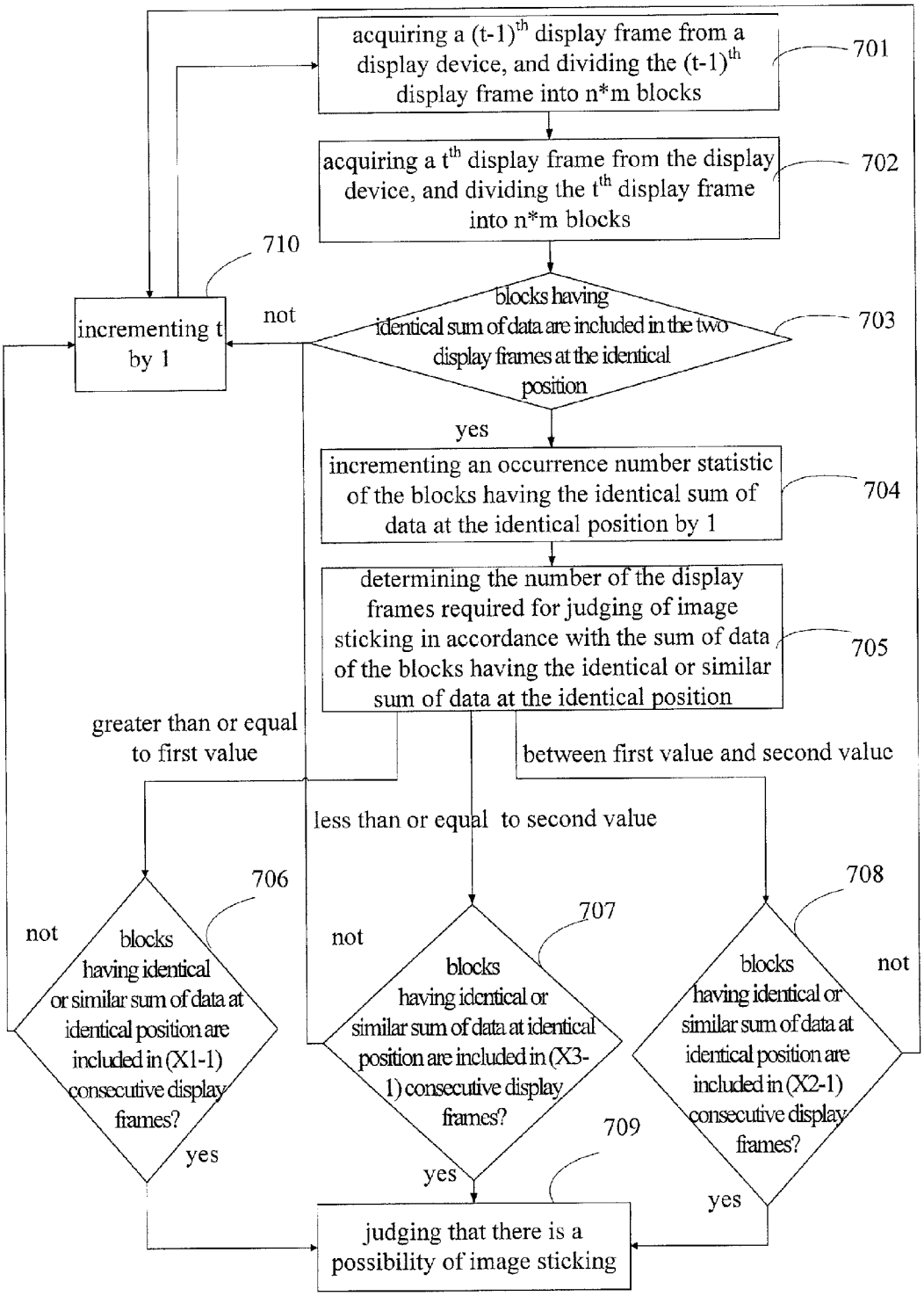
FIG. 7 is a flow chart of a method for reducing image sticking according to a sixth embodiment of the present disclosure.

Referring to FIG. 7, FIG. 7 is a flow chart of a method for reducing image sticking according to the sixth embodiment of the present disclosure, the method includes the following steps.

Step 701: acquiring a $(t-1)^{th}$ display frame from a display device, and dividing the $(t-1)^{th}$ display frame into n*m blocks, where t is a positive integer greater than 1, n and m are both positive integers greater than or equal to 2, and the n*m blocks are of an identical size.

Step 702: acquiring a $t^{th}$ display frame from the display device, and dividing the $t^{th}$ display frame into n*m blocks.

Step 703: comparing sums of data of all the pixels in blocks at an identical position of the $(t-1)^{th}$ display frame and the $t^{th}$ display frame, judging whether or not blocks having an identical sum of data are included in the $t^{th}$ and $(t-1)^{th}$ display frames at the identical position; if yes, proceeding to Step 704, otherwise, proceeding to Step 710.

Step 704: incrementing an occurrence number statistic of the blocks having the identical sum of data at the identical position by 1, an initial value of the occurrence number statistic being 0.

Step 705: determining the number of the display frames required for judging of image sticking in accordance with the sum of data of the blocks having the identical or similar sum of data at the identical position; the sum of data of the blocks having the identical or similar sum of data at the identical position being inversely proportional to the number of the display frames.

Step 706: when the sum of data of the blocks having the identical sum of data at the identical position is greater than or equal to a first value, judging whether or not one block whose occurrence number statistic is equal to X1−1 is included in the blocks having the identical sum of data at the identical position; if yes, proceeding to Step 709, otherwise, proceeding to Step 710.

Step 707: when the sum of data of the blocks having the identical sum of data at the identical position is smaller than or equal to a second value, judging whether or not one block whose occurrence number statistic is equal to X3−1 is included in the blocks having the identical sum of data at the identical position, if yes, proceeding to Step 709, and otherwise, proceeding to Step 710.

Step 708: when the sum of data of the blocks having the identical sum of data at the identical position is between the first value and the second value, judging whether or not one block whose occurrence number statistic is equal to X2−1 is included in the blocks having the identical sum of data at the identical position; if yes, proceeding to Step 709, otherwise, proceeding to Step 710.

Step 709: judging that there is a possibility of image sticking, and executing a prevention mechanism for image sticking.

Step 710: incrementing t by 1, and returning to Step 701.

X1 is a positive integer greater than or equal to 2, X2 and X3 are both positive integers greater than 2, X3>X2>X1, and the first value is greater than the second value.

Figure 8:
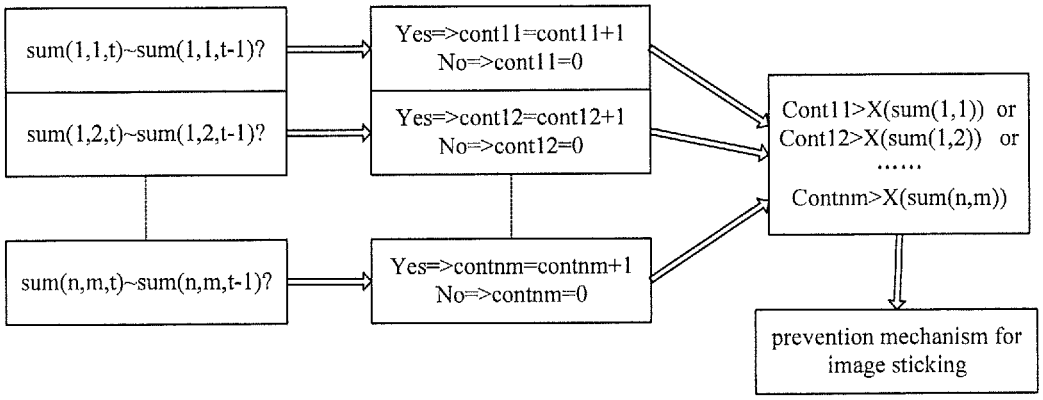
FIG. 8 is a schematic view showing a method for comparing sums of data of the blocks according to the sixth embodiment of the present disclosure.

Referring to FIG. 8, FIG. 8 is a schematic view showing a method for comparing sums of data in the blocks according to the sixth embodiment of the present disclosure, sum(n, m,t) represents a sum of data of a block (n,m) for the $t^{th}$ display frame, contnm represents a occurrence number statistics of the block (n,m), and X(sum(n,m)) represents a maximum value of the occurrence number statistic of the block (n,m), i.e., X1, X2 or X3.

Seventh Embodiment

The prevent disclosure provides in this embodiment a device for reducing image sticking, which includes:

an acquisition module configured to sequentially acquire a plurality of display frames from a display device;

a dividing module configured to divide each of the plurality of display frames into a plurality of blocks;

a first judgment module configured to judge whether or not blocks having identical or similar image information are included at an identical position in two consecutive display frames;

a first determination module configured to determine brightness information of the blocks having the identical or similar image information at the identical position when the blocks having the identical or similar image information are included at the identical position in two consecutive display frames;

a second determination module configured to determine the number X of the display frames required for judging of image sticking in accordance with the brightness information of the blocks having the identical or similar image information at the identical position; brightness of the blocks having the identical or similar image information at the identical position being inversely proportional to the number X of the display frames; and a second judgment module configured to judge whether or not blocks having identical or similar image information at an identical position are included in X consecutive display frames; and if yes, judge that there is a possibility of image sticking, where X is a positive integer greater than or equal to 2.

Alternatively, the device for reducing image sticking may further includes an execution module configured to execute a prevention mechanism for image sticking after the judgment module judges that there is a possibility of image sticking.

In this embodiment, the shape and the number of the divided blocks are not particularly limited. In addition, the blocks obtained by dividing one display frame may be of an identical size or different sizes.

In some other embodiments of the present disclosure, there is such a dividing mode in the extreme case that each block just includes one pixel point.

The image information may be a sum of data of all pixels in the block. Then, the blocks having identical image information at an identical position refer to blocks having an identical sum of data of all the pixels in the respective blocks at the identical position; and the blocks having similar image information at an identical position refer to blocks at the identical position in which a difference between the sums of data of all the pixels falls within a predetermined range.

Of course, the image information may also be data of each pixel in the block. Then, the blocks having identical image information at an identical position refer to blocks having identical data for each pixel in the respective blocks at the identical position; and the blocks having similar information at an identical position refer to blocks having an identical sum of data for Y % of the pixels in the respective blocks at the identical position, for example, Y is 90.

According to the device provided in the above embodiment, the timing when the image sticking is likely to occur may be effectively judged, thereby to facilitate the subsequent execution of a prevention mechanism for image sticking.

In the above embodiment, after the step of judging that there is a possibility of image sticking, the method may further include a step of executing the prevention mechanism for image sticking.

Specifically, the execution module may execute the prevention mechanism for image sticking by: shifting a position of an image in a current display frame to be displayed; or reducing the brightness of the current display frame to be displayed.

Of course, the execution of the prevention mechanism for image sticking are not limited to the above two modes, and other prevention mechanisms in the related art may also be adopted.

The present disclosure further provides in one embodiment a display device including the device for reducing image sticking in any one of the above embodiments.

The display device of the above embodiments may be an AMOLED display device, or other display device where image sticking may easily occur.

The above are merely optional embodiments of the present disclosure. It should be appreciated that, a person skilled in the art may make further modifications and improvements without departing from the principle of the present disclosure, and these modifications and improvements shall also fall within the scope of the present disclosure.

What is claimed is:

1. A method for reducing image sticking, comprising:

an acquisition step of sequentially acquiring a plurality of display frames from a display device;

a dividing step of dividing each of the plurality of display frames into a plurality of blocks;

a first judgment step of judging whether or not blocks having identical or similar image information are included at an identical position in two consecutive display frames;

a first determination step of determining brightness information of the blocks having the identical or similar image information at the identical position when the blocks having the identical or similar image information are included at the identical position in the two consecutive display frames;

a second determination step of determining a value of X in accordance with the brightness information of the blocks having the identical or similar image information at the identical position, wherein X means a number of display frames required for judging of image sticking; and a second judgment step of judging that there is a possibility of image sticking when blocks having identical or similar image information are included at an identical position in X consecutive display frames;

wherein X is a positive integer greater than or equal to 2 and wherein brightness of the blocks having the identical or similar image information at the identical position is inversely proportional to the value of X.

2. The method according to claim 1, wherein the image information of the block is a sum of data of all pixels in the block, the blocks having the identical image information at the identical position refer to blocks having an identical sum of data of all the pixels in the respective blocks at the identical position, and the blocks having the similar image information at the identical position refer to blocks at the identical position in which a difference between the sums of data of all the pixels falls within a predetermined range.

3. The method according to claim 1, wherein the image information of the block is data of each pixel in the block, the blocks having the identical image information at the identical position refer to blocks having identical data for each pixel in the respective blocks at the identical position, and the blocks having the similar information at the identical position refer to blocks having an identical sum of data of the pixels at a predetermined percentage in the respective blocks at the identical position.

4. The method according to claim 1, wherein after the step of judging that there is a possibility of image sticking, the method further comprises an execution step of executing a prevention mechanism for image sticking.

5. The method according to claim 4, wherein the execution step comprises:

shifting a position of an image in a current display frame to be displayed; or reducing brightness of the current display frame to be displayed.

6. The method according to claim 1, wherein the plurality of blocks is of an identical size or different sizes.

7. The method according to claim 1, wherein the brightness information of the block is a sum of the data of all pixels in the block.

8. A device for reducing image sticking, comprising:

an acquisition driver configured to sequentially acquire a plurality of display frames from a display device;

a dividing driver configured to divide each of the plurality of display frames into a plurality of blocks;

a first judgment driver configured to judge whether or not blocks having identical or similar image information are included at an identical position in two consecutive display frames;

a first determination driver configured to determine brightness information of the blocks having the identical or similar image information at the identical position when the blocks having the identical or similar image information are included at the identical position in the two consecutive display frames;

a second determination driver configured to determine a value of X in accordance with the brightness information of the blocks having the identical or similar image information at the identical position, wherein X means a number of display frames required for judging of image sticking; and a second judgment driver configured to judge that there is a possibility of image sticking when blocks having identical or similar image information are included at an identical position in X consecutive display frames;

wherein X is a positive integer greater than or equal to 2 and wherein brightness of the blocks having the identical or similar image information at the identical position is inversely proportional to the value of X.

9. The device according to claim 8, wherein the image information of the block is a sum of data of all pixels in the block, the blocks having the identical image information at the identical position refer to blocks having an identical sum of data of all the pixels in the respective blocks at the identical position, and the blocks having the similar image information at the identical position refer to blocks at the identical position in which a difference between the sums of data of all the pixels falls within a predetermined range.

10. The device according to claim 8, wherein the image information of the block is data of each pixel in the block, the blocks having the identical image information at the identical position refer to blocks having identical data for each pixel in the respective blocks at the identical position, and the blocks having the similar information at the identical position refer to blocks having an identical sum of data for the pixels at a predetermined percentage in the respective blocks at the identical position.

11. The device according to claim 8, further comprising:

an execution module configured to execute a prevention mechanism for image sticking after the judgment module judges that there is the possibility of image sticking.

12. The device according to claim 11, wherein the execution module is configured to shift a position of an image in a current display frame to be displayed, or reduce brightness of the current display frame to be displayed.

13. The device according to claim 8, wherein the plurality of blocks is of an identical size or different sizes.

14. The device according to claim 8, wherein the brightness information of the block is a sum of data of all pixels in the block.

15. A display device comprising a device for reducing image sticking; wherein the device for reducing image sticking comprises:

an acquisition driver configured to sequentially acquire a plurality of display frames from a display device;

a dividing driver configured to divide each of the plurality of display frames into a plurality of blocks;

a first judgment driver configured to judge whether or not blocks having identical or similar image information are included at an identical position in two consecutive display frames;

a first determination driver configured to determine brightness information of the blocks having the identical or similar image information at the identical position when the blocks having the identical or similar image information are included at the identical position in the two consecutive display frames;

a second determination driver configured to determine a value of X in accordance with the brightness information of the blocks having identical or similar image information at the identical wherein X means a number of display frames required for judging of image sticking; and a second judgment driver configured to judge that there is a possibility of image sticking when blocks having identical or similar image information are included at an identical position in X consecutive display frames;

wherein X is a positive integer greater than or equal to 2 and wherein brightness of the blocks having the identical or similar image information at the identical position is inversely proportional to the value of X.

* * * * *